US009821978B2

(12) United States Patent
Herrmann

(10) Patent No.: US 9,821,978 B2
(45) Date of Patent: Nov. 21, 2017

(54) SHEET STACKING SYSTEM FOR FLIMSY SHEETS

(71) Applicant: XEROX CORPORATION, Norwalk, CT (US)

(72) Inventor: Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/078,257

(22) Filed: Mar. 23, 2016

(65) Prior Publication Data

US 2017/0275122 A1 Sep. 28, 2017

(51) Int. Cl.

| | |
|---|---|
| ***G03G 15/00*** | (2006.01) |
| ***B65H 29/24*** | (2006.01) |
| ***B65H 29/14*** | (2006.01) |
| ***B65H 31/02*** | (2006.01) |

(52) U.S. Cl.

CPC ..... *B65H 29/247* (2013.01); *B65H 29/14* (2013.01); *B65H 31/02* (2013.01); *G03G 15/6561* (2013.01)

(58) Field of Classification Search

CPC ..... B65H 29/247
USPC ..... 399/405
See application file for complete search history.

(56) References Cited

U.S. PATENT DOCUMENTS

| | | | | |
|---|---|---|---|---|
| 3,727,911 | A * | 4/1973 | Vits | B65H 29/247 271/195 |
| 3,971,554 | A * | 7/1976 | Stange | B65H 29/247 271/177 |
| 4,625,956 | A * | 12/1986 | Marass | B65H 29/247 271/176 |
| 4,903,956 | A * | 2/1990 | Stephens | B65H 29/40 271/178 |
| 4,953,894 | A * | 9/1990 | Broszat | B60G 7/005 280/86.755 |
| 5,102,118 | A * | 4/1992 | Vits | B65H 23/24 226/196.1 |
| 5,671,920 | A * | 9/1997 | Acquaviva | B65H 29/32 271/182 |
| 5,941,520 | A * | 8/1999 | Stephan | B41F 21/00 271/195 |
| 5,951,006 | A | 9/1999 | Biegelsen et al. | |
| 6,091,929 | A | 7/2000 | Yamazaki et al. | |
| 6,196,540 | B1 * | 3/2001 | Schmid | B65H 29/246 271/177 |
| 6,846,151 | B2 | 1/2005 | Mayerbert, II et al. | |
| 7,140,828 | B2 | 11/2006 | Mayerbert, II et al. | |
| 8,096,553 | B2 * | 1/2012 | Obuchi | B65H 29/041 271/215 |
| 2008/0315498 | A1 * | 12/2008 | Ikeda | B65H 1/08 271/18 |

* cited by examiner

*Primary Examiner* — Anthony Nguyen

(57) ABSTRACT

A sheet stacking tray that includes a single pneumatic baffle which uses the pressure differential caused by the flow of air across a horizontal planar surface of the pneumatic baffle to hold the lead edge of sheets driven by an input nip into the sheet stacking tray above a stack especially for longer and lighter weight sheets as they are driven by the input nip to a registration wall.

4 Claims, 2 Drawing Sheets

SHEET STACKING SYSTEM FOR FLIMSY SHEETS

BACKGROUND

1. Field of the Disclosure

This invention relates generally to electrostatographic reproduction machines, and more particularly, to a pneumatic baffle system for cut sheet finishing systems used in such electrostatographic reproduction machines.

2. Description of Related Art

Typically, in an electrostatotographic printing process of printers, such as, U.S. Pat. No. 6,091,929, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

A finisher is usually arranged in a post processing position to receive the fused copy substrates or sheets and staple them, if desired. In many such finishing, tamping systems are commonly used to register the sheets in compiler trays. Sheets are usually scuffed against a lead edge registration wall of the compiler trays for various post finisher functions, such as, hole punching, corner stapling, edge stapling, sheet and set stacking, letter or tri-folding, Z-folding, Bi-folding, signature booklet making, set binding, trimming, post process sheet insertion, saddle stitching and others.

In finishers or stackers of this type which stack incoming media sheets directly on top of a previous sheet or stack, it is necessary to ensure the lead edge of each sheet is delivered to a registration wall consistently. A problem is presented due to the interaction of the lead edge of the incoming sheet on the stack surface. As the stack builds the top surface becomes uneven due to curl and ink/toner buildup and can cause the incoming sheet to roll over and jam. Corrugation rolls are often used to put corrugation into the sheet but the effectiveness decreases as the sheets become longer, lighter or if the lead edge of the sheet is deflected by a baffle or guide. The weight of the longer sheets overcome the beam strength of the nip corrugation causing the lead edge of the sheet to droop and inconsistent feed distances result. No static lower baffle is possible because the sheets must drop onto the stack below. Some finisher systems use active shutters to collate the sheets on a flat surface and then move the shutters out to the sides to drop the sheets. This adds a much higher level of complexity and cost. No mechanism or method is known that will keep the sets from migrating away from the registration wall when a scuffer is lifted for engagement of a side tamping function and the sheets consistently migrate away from the registration wall. This impacts the in-set registration which needs to be especially tight for stapled sets.

A decoupling mechanism is shown in U.S. Pat. No. 5,951,006 for passively or actively decoupling an exhaust from a modular air transport systems by diverting an amount of air exiting in a channel in a first module in a direction other than the process direction through use of the Coanda effect. This decouples the amount of air from a downstream module. This is achieved by providing edge surfaces of the channel outlet, formed on top and bottom plates of the first air module, so that one of the two edge surfaces has a larger radius of curvature than the other. An air vent formed by a gap between the other edges and a second module is also provided to assist in the Coanda effect. In U.S. Pat. Nos. 7,140,828 B2 and 6,846,151 B2 objects such as mail are stacked without significant contact therewith by producing laminar air flow over a surface which defines or parallels a desired movement path for the objects. A high speed printed sheet stacking and registration system is shown in U.S. Pat. No. 5,671,920 that employs a vacuum belt sheet transport to hold sheets above a compiled stack while they enter a stacker and uses a normal force system to peel the sheets from the vacuum transport so they can land on top of compiled sheets.

Obviously, there is still a need for an improved compiling and registration finishing apparatus and method, especially for flimsy sheets.

BRIEF SUMMARY

Accordingly, an improved a pneumatic baffle system for a cut sheet finishing system that maintains the height of a nip driven sheet above a compiled stack of sheets is disclosed. When feeding long flexible sheets onto a compiled stack, a sheet may lose its beam strength and the lead edge will dive into the stack before reaching a registration wall. Even with added mechanical corrugation the beam strength may be lost over a long distance or if the sheet is deflected by a baffle. A thin layer of high velocity air is applied between the top side of the sheet and a baffle while the sheet is simultaneously fed by and held within a feed roll nip. The layer of high velocity air that follows a horizontal bottom surface of the baffle and the high velocity air "lifts" the sheet (Bernoulli Effect) to the boundary layer of air flowing over the baffle. The sheet continues to be fed by the drive nip to where it can be nudged into the registration wall.

BRIEF DESCRIPTION OF THE DRAWINGS

The disclosed printer system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

Figure 1:
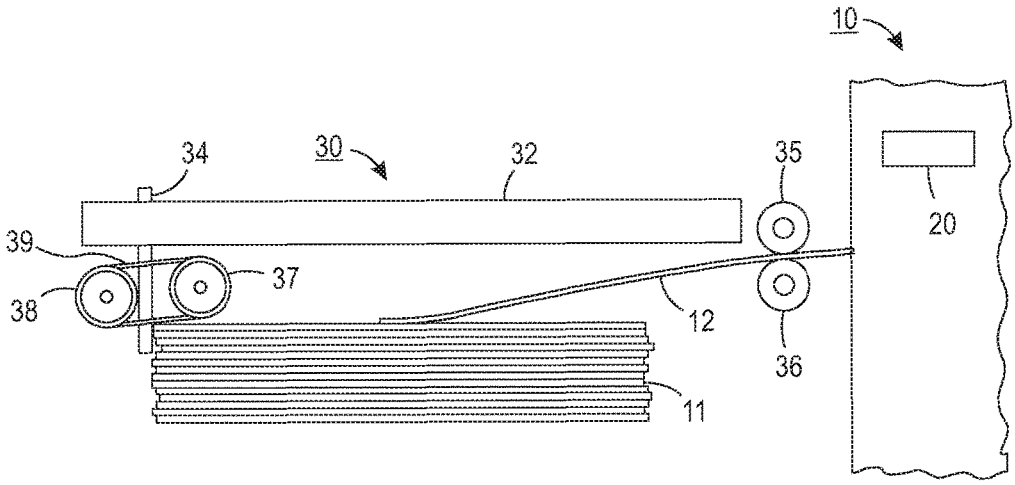

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
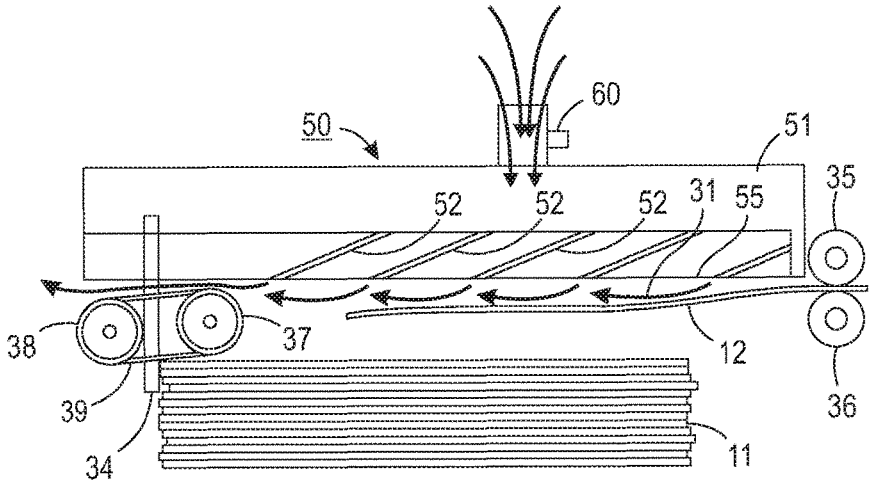
Figure 3:
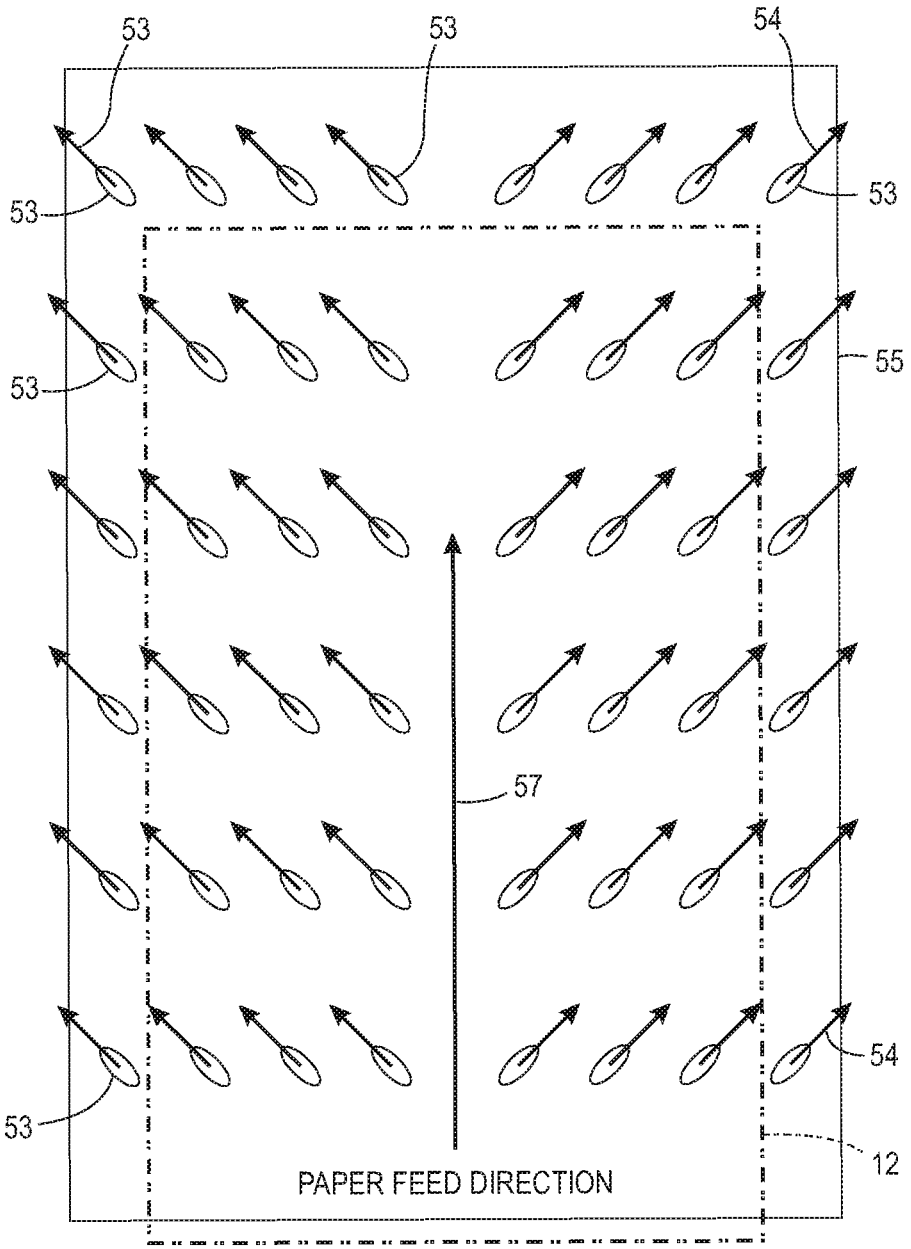

Several of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 1 is an enlarged partial elevational schematic view showing relevant elements of an exemplary printing machine including a sheet stacker;

FIG. 2 is an enlarged partial schematic side view of an improved sheet stacker apparatus for use in the printing machine of FIG. 1 that includes a pneumatic baffle; and FIG. 3 is an enlarged partial schematic bottom view of the pneumatic baffle of FIG. 2.

A sheet stacker 30 is shown in FIG. 1 receiving sheets 12 from printer 10 that form a stack 11 therein. Sheet stacker 30 includes a conventional movable platform (not shown) that is indexed periodically in order to maintain a predetermined stack height. Controller 20 actuates printer 10 to output imaged sheets 12 for compiling in stacker 30 that includes a support frame 32, a conventionally vertically movable registration wall 34 and a scuffer drive that includes a drive roll 37 and idler roll 38 drivingly connected by belt 39. As shown, sheet 12 is driven by a nip formed between drive roll 36 and driven or idler roll 35 onto stack 11. In stacking systems of this type which stack incoming sheets 12 directly on top of previously stacked sheets, a problem sometimes arises due to the interaction of the lead edge of the incoming sheet contacting the sheet stack. Build-up of the sheet stack becomes uneven due to curl or toner build-up and can cause an incoming sheet to roll over as it jams against the sheet stack. And sheets of longer length can droop soon after leaving the input drive nip and can roll over and jam.

A solution to this problem is shown in FIG. 2 that comprises a single upper pneumatic baffle 50 that uses the pressure differential caused by the flow of air across a flat horizontal surface 55 to hold the lead edge of the sheet above the stack, especially for longer and lighter weight sheets, while they are driven by the input nip rolls 35 and 36 to the registration wall 34. Pneumatic baffle 50 has an air chamber 51 that includes a sensor controlled valve 60 through controller 20 that either allows air into the chamber or closes off the chamber to the inflow of air. Air cut-off valve 60 is moved from ON to and OFF position immediately before each sheet impacts registration wall 34 to allow the sheets to drop onto the sheet stack. Opening and closing of cut-off valve 60 is triggered based upon sheet length while registration wall 34 is adjusted based upon sheet length and weight. Air chamber 51 has a series or plurality of nozzles 52 that channel air flow from the chamber as represented by arrows 31 to an outer planar and horizontally extending surface thereof 55. Pneumatic baffle 50 maintains the height of nip driven sheet 12 above compiled stack of sheets 11 through high velocity of air through nozzles 52 that attracts each sheet to one side by lowering the pressure of the side of the sheet where the air is moving across the sheet. This unique method of controlling the height of sheets coming into a stacker with respect to sheets already in the stacker is especially useful when feeding long flimsy sheets onto a compiled stack since the sheets may lose their beam strength and cause the lead edges of the sheets to dive into the stack and roll over before reaching the registration wall.

FIG. 3 shows a bottom view of the horizontal surface 55 of pneumatic baffle 50 with a sheet 12 positioned there against and conveyed in the direction of arrow 57. A matrix of oval shaped outlets 53 of nozzles 52 are shown positioned at acute angles towards the outer edges of sheet 12 as indicated by arrows 54. Outlets 53 of nozzles 52 are positioned to cover a variety of sheet lengths and widths. The laminar stream of air across the sides of the chamber surface 55 will keep wider sheets from drooping.

In recapitulation, the embodiment of the present disclosure addresses a problem encountered when feeding sheets, including flimsy sheets, into a stacker. Namely, sheets stubbing against a compiled stack and thereby causing the incoming sheets to roll over and cause jams. This is especially true of flimsy sheets and longer length and wider widths of flimsy sheets. The present disclosure solves this problem by providing a pneumatic baffle system that uses an air pressure differential caused by high velocity air (Bernoulli Effect) to keep an incoming sheet elevated above a collated stack or tray while the sheet is simultaneously driven by an input drive nip. Thus, a boundary layer of air along the underside of a horizontally extending surface of the pneumatic baffle keeps incoming sheets to a finisher or stacker supported above the stack without the need for a second baffle.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A sheet stacking system with a sheet stacking area for sequentially stacking printed sheet output of a reproduction apparatus being sequentially fed to said sheet stacking area, the improvement in high speed sheet stacking and improved sheet control, comprising:

a sheet stacker for receiving sheets therein, said sheet stacker including a registration wall where sheets are registered thereagainst and form a stack within said sheet stacker;

a continuously engaged input nip for capturing said sheets and maintaining control of said sheets until immediately before they reach said registration wall;

a pneumatic baffle that includes a horizontal bottom surface positioned parallel to and above sheets within said sheet stacker, said horizontal bottom surface including air nozzles having outlets configured to direct air at acute angles from a sheet process direction in order to balance the flow by allowing for a flow vector in the sheet process direction along with a flow vector away from the sheet process direction and to the edge of the sheet to provide for flow at the edges of the sheet, said pneumatic baffle using a pressure differential caused by the flow of air across said horizontal bottom surface to hold a lead edge of each incoming sheet above said stack including longer and lighter weight sheets as they are driven by said input nip to said registration wall while simultaneously maintaining said sheets out of contact with said horizontal bottom surface of said pneumatic baffle; and a controller, said controller being configured to shut off air into said pneumatic baffle immediately before each sheet impacts said registration wall to allow each sheet to drop onto said stack without impacting said registration wall.

2. The sheet stacking system of claim 1, wherein said pneumatic baffle includes a cut-off valve and wherein said cut-off valve is triggered by said controller to shut off air flow to said pneumatic baffle based upon sheet length.

3. The sheet stacking system of claim 1, wherein said horizontal surface of said pneumatic baffle includes air nozzles angled with respect to said horizontal surface.

4. The sheet stacking system of claim 3, wherein said sheet stacking system is part of a xerographic device.

* * * * *